US005529044A

United States Patent [19]

Barnes et al.

[11] Patent Number: 5,529,044

[45] Date of Patent: Jun. 25, 1996

[54] METHOD FOR CONTROLLING THE FUEL INJECTION RATE OF A HYDRAULICALLY-ACTUATED FUEL INJECTION SYSTEM

[75] Inventors: Travis E. Barnes, Peoria, Ill.; Brian E. Uhlenhake, Frisco, Tex.

[73] Assignee: Caterpillar Inc., Peoria, Ill.

[21] Appl. No.: 283,135

[22] Filed: Jul. 29, 1994

[51] Int. Cl.[6] ..... F02M 37/04

[52] U.S. Cl. ..... 123/496

[58] Field of Search ..... 123/299, 300, 123/446, 500, 501, 496

[56] References Cited

U.S. PATENT DOCUMENTS

| | | | |
|---|---|---|---|
| Re. 33,270 | 7/1990 | Beck et al. | 123/447 |
| 4,368,705 | 1/1983 | Stevenson et al. | 123/357 |
| 4,870,939 | 10/1989 | Ishikawa et al. | 123/506 |
| 5,024,200 | 6/1991 | Free et al. | 123/501 |
| 5,143,291 | 9/1992 | Grinsteiner | 239/88 |
| 5,152,266 | 10/1992 | Sekiguchi et al. | 123/357 |
| 5,168,855 | 12/1992 | Stone | 123/446 |
| 5,176,115 | 1/1993 | Campion | 123/179.17 |
| 5,181,494 | 1/1993 | Ausman et al. | 123/446 |
| 5,191,867 | 3/1993 | Glassey | 123/446 |
| 5,245,970 | 9/1993 | Iwaszkiewicz et al. | 123/447 |
| 5,261,366 | 11/1993 | Regueiro | 123/299 |
| 5,313,924 | 5/1994 | Regueiro | 123/456 |
| 5,357,912 | 10/1994 | Barnes et al. | 123/446 |
| 5,445,129 | 8/1995 | Barnes | 123/496 |
| 5,447,138 | 9/1995 | Barnes | 123/496 |

FOREIGN PATENT DOCUMENTS 0149598 7/1985 European Pat. Off. .

*Primary Examiner*—Thomas N. Moulis
*Attorney, Agent, or Firm*—David M. Masterson

[57] ABSTRACT

In one aspect of the present invention, a method is disclosed for controlling the fuel injection rate of a hydraulically-actuated fuel injector. A desired actuating fluid pressure is determined based on the engine speed and temperature. The desired actuating fluid pressure is used to control the fuel injection rate to result in quick engine starting.

11 Claims, 4 Drawing Sheets

METHOD FOR CONTROLLING THE FUEL INJECTION RATE OF A HYDRAULICALLY-ACTUATED FUEL INJECTION SYSTEM

TECHNICAL FIELD

This invention relates generally to a method for controlling the fuel injection rate and, more particularly, to a method for controlling the fuel injection rate by controlling the actuating fluid pressure of a hydraulically-actuated fuel injector.

BACKGROUND ART

A diesel engine achieves combustion by injecting fuel that vaporizes into the hot air of an engine cylinder. However, during cold starting conditions, the air loses much of its heat to the cylinder walls making engine starting difficult. For example, if fuel is injected into the cylinder too quickly, the heat required to vaporize the cold fuel reduces the air temperature about the injection point and may prevent or quench combustion. Thus, it is desirable to inject fuel slowly to disperse the fuel throughout the combustion chamber to evenly distribute the resulting heat losses in order to cause combustion.

The injection rate of hydraulically-actuated fuel injector systems, similar to those described in U.S. Pat. Nos. 5,191,867 and 5,181,494, is controlled by the actuating fluid pressure and viscosity. However, the fluid viscosity changes in response to fluid temperature and fluid grades. Therefore, it is desirable to control the actuating fluid pressure as a function of the fluid temperature and grade.

The present invention is directed to overcoming one or more of the problems as set forth above.

DISCLOSURE OF THE INVENTION

In one aspect of the present invention, a method is disclosed for controlling the fuel injection rate of a hydraulically-actuated fuel injector. A desired actuating fluid pressure is determined based on the engine speed and temperature. The desired actuating fluid pressure is used to control the fuel injection rate to result in quick engine starting.

In another aspect of the present invention, a method is disclosed for determining a desired actuating fluid pressure used to slow the fuel injection rate by causing multiple injections during a single injection period.

In yet another aspect of the present invention, a method is disclosed for determining a desired fuel injection rate based on the engine speed and temperature. In response to the desired fuel injection rate and actuating fluid viscosity, a desired actuating fluid pressure is determined to control the fuel injection rate.

BRIEF DESCRIPTION OF THE DRAWINGS

For a better understanding of the present invention, reference may be made to the accompanying drawings in which.

BEST MODE FOR CARRYING OUT THE INVENTION

The present invention relates to an electronic control system for use in connection with a hydraulically actuated electronically controlled unit injector fuel system. Hydraulically actuated electronically controlled unit injector fuel systems are known in the art. One example of such a system is shown in U.S. Pat. No. 5,191,867, issued to Glassey on Mar. 9, 1993, the disclosure of which is incorporated herein by reference.

Figure 1:
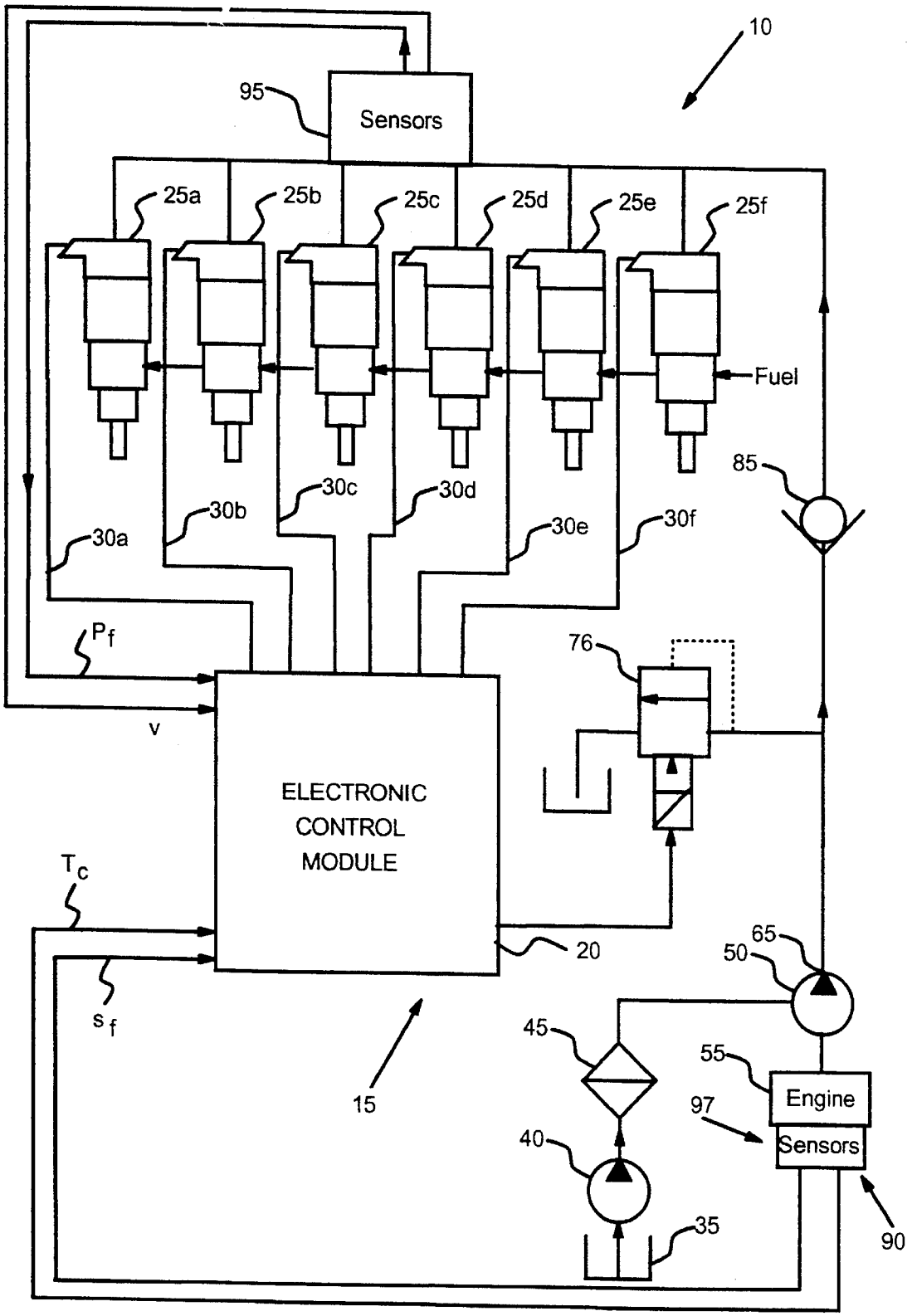
FIG. 1 is a diagrammatic general schematic view of a hydraulically-actuated electronically-controlled injector fuel system for an engine having a plurality of injectors.

Throughout the specification and figures, like reference numerals refer to like components or parts. Referring first to FIG. 1, a preferred embodiment of the electronic control system 10 for a hydraulically actuated electronically controlled unit injector fuel system is shown, hereinafter referred to as the HEUI fuel system. The control system includes an Electronic Control Module 15, hereinafter referred to as the ECM. In the preferred embodiment the ECM is a Motorolla microcontroller, model no. 68HC11. However, many suitable controllers may be used in connection with the present invention as would be known to one skilled in the art.

The electronic control system 10 includes hydraulically actuated electronically controlled unit injectors 25*a–f* which are individually connected to outputs of the ECM by electrical connectors 30*a–f* respectively. In FIG. 1, six such unit injectors 25*a–f* are shown illustrating the use of the electronic control system 10 with a six cylinder engine 55. However, the present invention is not limited to use in connection with a six cylinder engine. To the contrary, it may be easily modified for use with an engine having any number of cylinders and unit injectors 25. Each of the unit injectors 25*a–f* is associated with an engine cylinder as is known in the art. Thus, to modify the preferred embodiment for operation with an eight cylinder engine would require two additional unit injectors 25 for a total of eight such injectors 25.

Actuating fluid is required to provide sufficient pressure to cause the unit injectors 25 to open and inject fuel into an engine cylinder. In a preferred embodiment the actuating fluid comprises engine oil and the oil supply is the engine oil pan 35. Low pressure oil is pumped from the oil pan by a low pressure pump 40 through a filter 45, which filters impurities from the engine oil. The filter 45 is connected to a high pressure fixed displacement supply pump 50 which is mechanically linked to, and driven by, the engine 55. High pressure actuating fluid (in the preferred embodiment, engine oil) enters an Injector Actuation Pressure Control Valve 76, hereinafter referred to as the IAPCV. Other devices, which are well known in the art, may be readily and easily substituted for the fixed displacement pump 50 and the IAPCV. For example, one such device includes a variable pressure high displacement pump.

In a preferred embodiment, the IAPCV and the fixed displacement pump 50 permits the ECM to maintain a desired pressure of actuating fluid. A check valve 85 is also provided.

The ECM contains software decision logic and information defining optimum fuel system operational parameters and controls key components. Multiple sensor signals, indicative of various engine parameters are delivered to the ECM to identify the engine's current operating condition. The ECM uses these input signals to control the operation of the fuel system in terms of fuel injection quantity, injection timing, and actuating fluid pressure. For example, the ECM produces the waveforms required to drive the IAPCV and a solenoid of each injector 25.

The electronic control uses several sensors, some of which are shown. An engine speed sensor 90 reads the signature of a timing wheel applied to the engine camshaft to indicate the engine's rotational position and speed to the ECM. An actuating fluid pressure sensor 95 delivers a signal to the ECM to indicate the actuating fluid pressure. Moreover, an engine coolant temperature sensor 97 delivers a signal to the ECM to indicate engine temperature.

Figure 2:
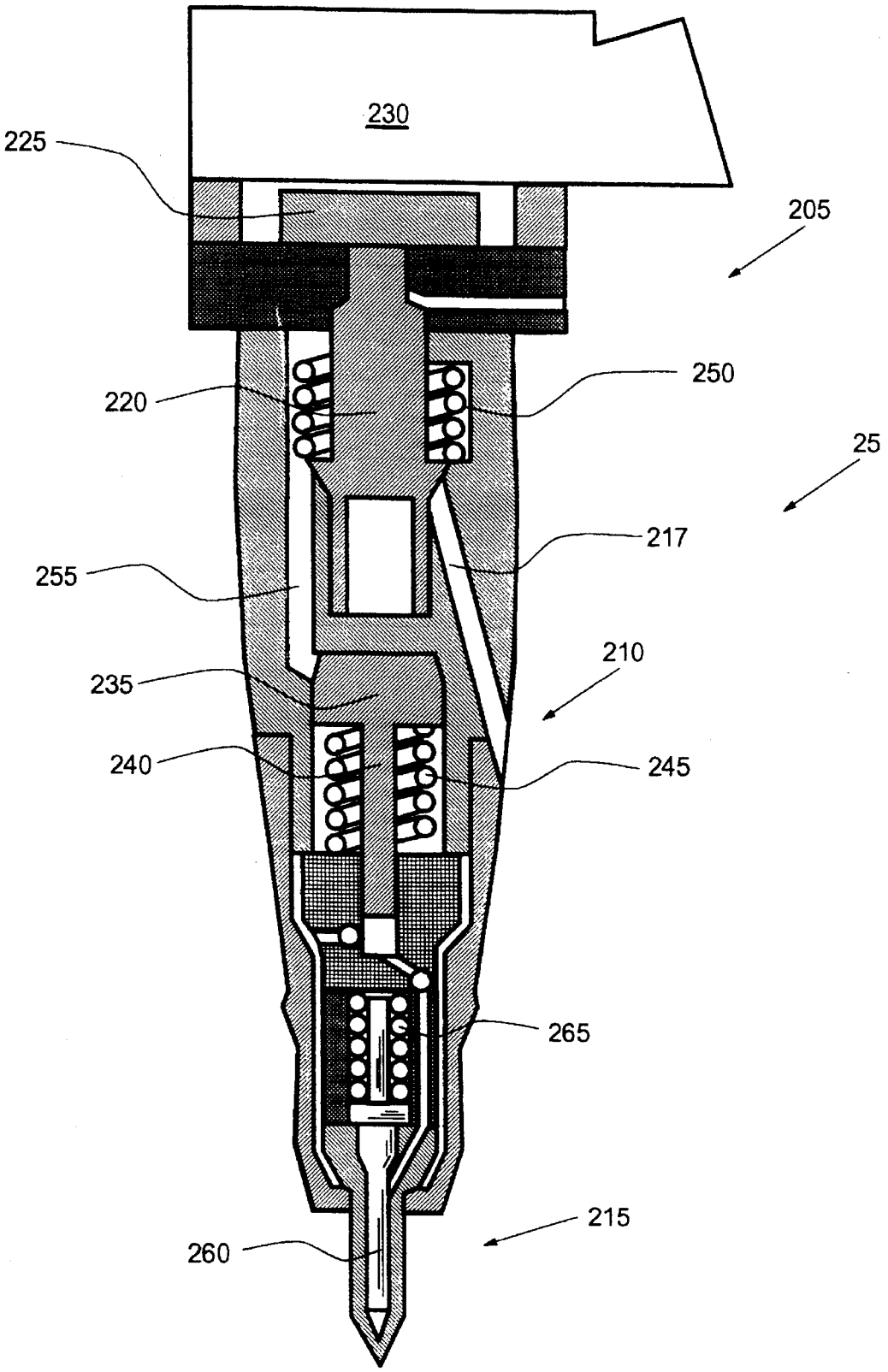
FIG. 2 is a cross sectional view of a hydraulically-actuated electronically-controlled injector for the fuel system of FIG. 1.

The injector operation will now be described with reference to FIG. 2. The injector 25 consists of three main components, a control valve 205, an intensifier 210, and a nozzle 215. The control valve's purpose is to initiate and end, the injection process. The control valve 205 includes a poppet valve 220, armature 225 and solenoid 230. High pressure actuating fluid is supplied to the poppet valve's lower seat via passage 217. To begin injection, the solenoid is energized moving the poppet valve from the lower seat to an upper seat. This action admits high pressure oil to a spring cavity 250 and to the intensifier 210 via passage 255. Injection continues until the solenoid is de-energized and the poppet moves from the upper to the lower seat. Oil and fuel pressure decrease as spent oil is ejected from the injector through the open upper seat to the valve cover area.

The intensifier 210 includes a hydraulic intensifier piston 235, plunger 240, and return spring 245. Intensification of the fuel pressure to desired injection pressure levels is accomplished by the ratio of areas between the intensifier piston 235 and plunger 240. Injection begins as high pressure actuating fluid is supplied to the top of the intensifier piston. As the piston and plunger move downward, the pressure of the fuel below the plunger rises. The piston continues to move downward until the solenoid is de-energized causing the poppet 220 to return to the lower seat, blocking oil flow. The plunger return spring 245 returns the piston and the plunger to their initial positions. As the plunger returns, it draws replenishing fuel into the plunger chamber across a ball check valve.

Fuel is supplied to the nozzle 215 through internal passages. As fuel pressure increases, a needle lifts from a lower seat allowing injection to occur. As pressure decreases at the end of injection, a spring 265 returns the needle to its lower seat.

Typically, engine starting includes three engine speed ranges. For example, from 0–200 RPM the engine is said to be cranking (cranking speed range). Once the engine fires, then the engine speed accelerates from engine cranking speeds to engine running speeds (acceleration speed range). Once the engine speed reaches a predetermined engine RPM, e.g. 900 RPM, then the engine is said to be running (running speed range). The present invention is concerned with controlling the fuel injection to start an engine—especially where the engine temperature is below a predetermined temperature, e.g. 18° Celsius.

Figure 3:
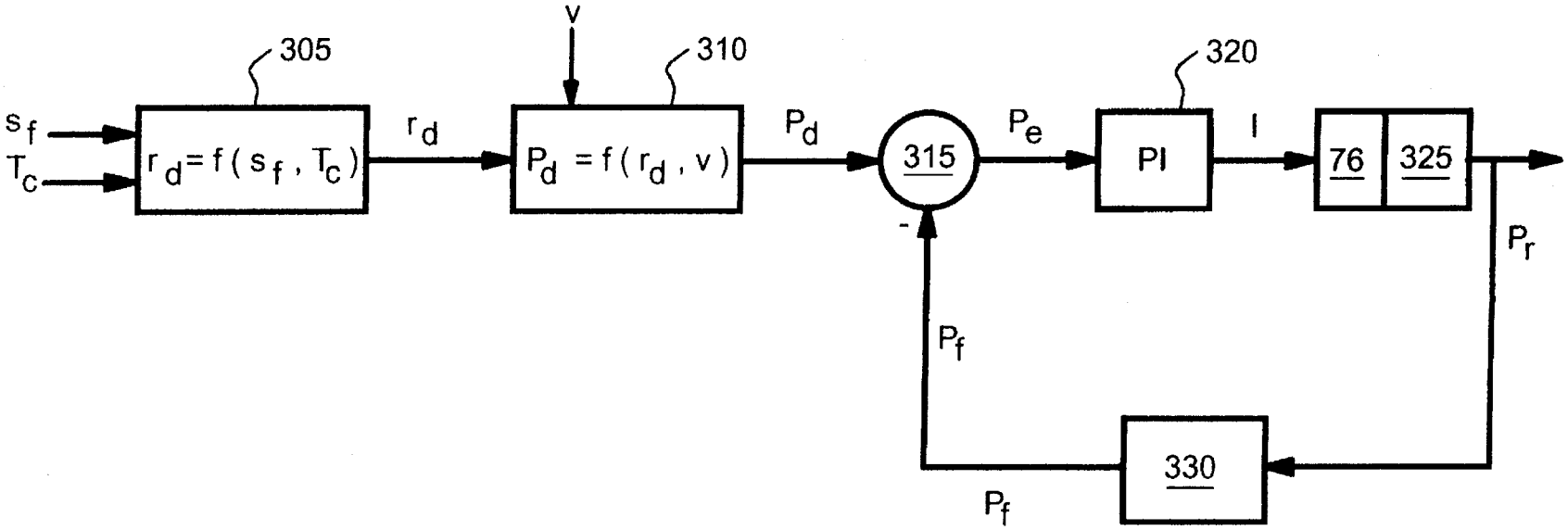
FIG. 3 is a block diagram of an actuating fluid pressure control strategy for the fuel system of FIG. 1.

The software decision logic for determining the magnitude of the actuating fluid pressure supplied to the injector 25 is shown with respect to FIG. 3. Preferably, the engine speed and the engine coolant temperature are sensed and their respective signals ($S_f$,$T_c$) are input into an injection rate block 305. Based on the magnitude of the sensed engine speed and coolant temperature, a desired injection rate signal $r_d$ is selected as an output. The desired injection rate signal $r_d$ is then input, along with an actuating fluid viscosity signal v, into an actuating fluid pressure block 310. The actuating fluid viscosity signal v, represents the viscosity of the actuating fluid which may be directly or indirectly sensed. Based on the magnitude of the desired injection rate and actuating fluid viscosity signals, a desired actuating fluid pressure signal $P_d$ is selected as an output. Note that, blocks 305,310 may be combined as one or more maps and/or equations to reflect the fuel delivery characteristics of the hydraulically-actuated injector 25 in response to changes in actuating fluid pressure and viscosity.

The desired actuating fluid pressure signal $P_d$ is then compared by block 315 with a measured actuating fluid pressure signal $P_f$ to produce an actuating fluid pressure error signal $P_e$. This actuating fluid pressure error signal $P_e$ is input to a PI control block 320 whose output is a desired electrical current I applied to the IAPCV. By changing the electrical current I to the IAPCV the actuating fluid pressure $P_f$ can be increased or decreased. For example, increasing the current I to fluid directly to the sump 97 at a higher pressure thereby increasing the actuating fluid pressure. Decreasing the current (I) to the IAPCV causes the IAPCV to bypass the actuating fluid to the sump 97 at a lower pressure thereby decreasing the actuating fluid pressure. The PI control 320 calculates the electrical current (I) to the IAPCV that would be needed to raise or lower the actuating fluid pressure $P_f$ to result in a zero actuating fluid pressure error signal $P_e$. The resulting actuating fluid pressure is used to hydraulically actuate the injector 25. Preferably, the raw actuating fluid pressure signal $P_r$ in the high pressure portion of the actuating fluid pressure circuit 325 is conditioned and converted by a PI conventional means 330 to eliminate noise and convert the signal to a usable form. Note that, although a PI control is discussed, it will be apparent to those skilled in the art that other controlled strategies may be utilized.

Thus, while the present invention has been particularly shown and described with reference to the preferred embodiment above, it will be understood by those skilled in the art that various additional embodiments may be contemplated without departing from the spirit and scope of the present invention.

Industrial Applicability

The subject invention improves engine starting by slowing the fuel injection rate. More particularly, the subject invention slows the fuel injection rate by lowering the actuating fluid pressure to a predetermined pressure range to achieve quicker starting.

Because of the physical characteristics of the fuel injector and the actuating fluid flow dynamics, at high actuating fluid viscosities and low actuating fluid pressures, multiple fuel injections may occur during the injection period.

More particularly, as the injector 25 dispenses fuel, the intensifier plunger 240 moves downward, which causes actuating fluid to flow into the control valve cavity 250. However, at high actuating fluid viscosities, actuating fluid flow losses develop, which decreases the actuating fluid pressure in the control valve cavity 250. If the pressure in the control valve cavity 250 drops below a predetermined value, the corresponding drop in fuel injection pressure will cause the needle 260 to close. However, as pressure builds in the control valve cavity, the fuel injection pressure will increase, causing the needle to open and once again dispense fuel. This repeated opening and closing of the needle may continue during the entire injection period causing fuel to be injected in a series of very short bursts. Consequently, multiple injection may provide many beneficial effects including lower emissions, reduced noise, reduced smoke, improved cold starting, white smoke clean-up, and high altitude operation.

The present invention provides for fuel to be injected over a longer period of time than tradition single-pulse injectors. This results in quicker engine starting because the fuel is injected slowly to disperse the fuel throughout the combustion chamber to prevent heat loss at the injection point to aid combustion. Moreover, where multiple injections are produced, the first of the multiple fuel pulses provides an initial flame that supplies heat to ignite the subsequent fuel pulses to quickly cause combustion.

Figure 4:
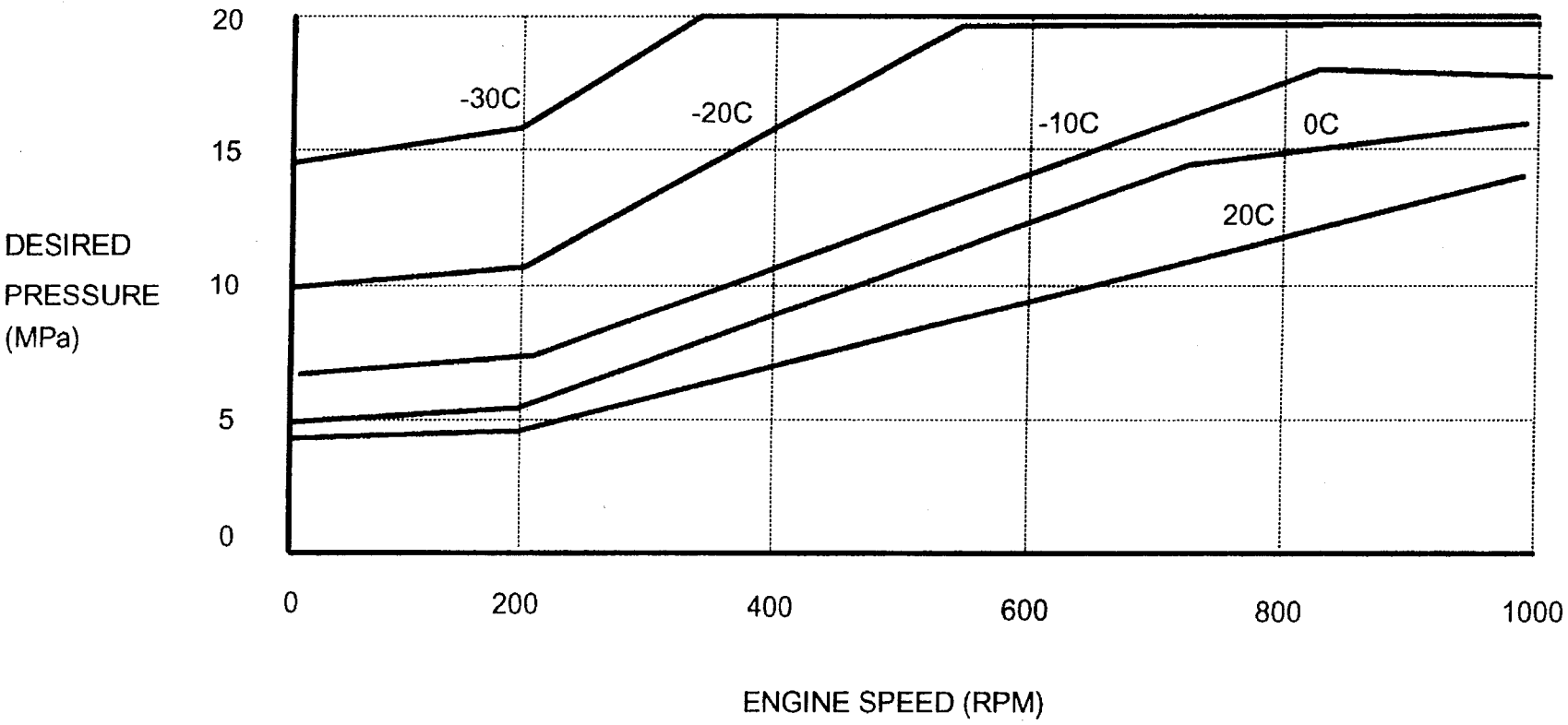
FIG. 4 is a pressure map for selecting a desired an actuated fluid pressure as a function of engine speed and temperature.

Referring now to FIG. 4, the desired actuating fluid pressure is a function of engine temperature and engine speed. Because it may be difficult to sense viscosity, either directly or indirectly, multiple maps similar to FIG. 4 may be utilized. For example, one map may correspond to a predetermined fluid grade, which has its own unique viscosity characteristics. However, because viscosity is also function of temperature, the engine temperature may be used to account for changes in viscosity for the particular fluid grade. Note that, the map shown herein is merely illustrative and the actual values of the map depend upon the actuating fluid viscosity and the dynamics of the fuel injector.

Note that, once the engine has fired, the engine will accelerate from cranking speed to running speed. Accordingly, the time in which fuel may be injected decreases, as engine speed increases. Thus, the map illustrates that the desired actuating fluid pressure increases (to increase the injection rate), as the engine speed increases, in order to inject a required quantity of fuel during a desired time period to maintain the engine acceleration.

Other aspects, objects and advantages of the present invention can be obtained from a study of the drawings, the disclosure and the appended claims.

We claim:

1. A method for controlling the pressure of a hydraulically-actuated injector (25) of an internal combustion engine (55), comprising the steps of:

sensing the temperature of the engine and producing an engine temperature signal ($T_c$) indicative of the temperature of actuating fluid used to hydraulically actuate the injector (25);

sensing the engine speed and producing an engine speed signal ($s_f$) indicative of the sensed engine speed;

receiving the engine speed and temperature signals, determining a rate at which injection is desired to occur, and producing a desired rate injection signal ($r_d$) indicative of the determined injection rate;

sensing a viscosity of the actuating fluid and producing a viscosity signal (v) indicative of the sensed actuating fluid viscosity;

receiving the engine speed and viscosity signals, determining a desired actuating fluid pressure, and producing a desired actuating fluid pressure signal ($P_d$) indicative of the magnitude of the desired actuating fluid pressure; and receiving the desired actuating fluid pressure signal ($P_d$), and producing a desired electrical current signal (I) to control the fuel injection rate.

2. A method, as set forth in claim 1, including the steps of:

sensing an actual actuating fluid pressure and producing an actual actuating fluid pressure signal ($P_f$) indicative of the magnitude of the sensed actuating fluid pressure;

comparing the desired actuating fluid pressure signal ($P_d$) with the actual actuating fluid pressure signal ($P_f$) and producing an actuating fluid pressure error signal ($P_e$) in response to a difference between the compared actuating fluid pressure signals ($P_d$, $P_f$); and receiving the actuating fluid pressure error signal ($P_e$), determining a desired electrical current based on the actuating fluid pressure error signal ($P_e$), and producing a desired electrical current signal (I).

3. A method, as set forth in claim 2, wherein the desired fluid pressure is determined to cause the fuel injector (25) to produce a plurality of injections during a single injection period at engine cranking speeds.

4. A method, as set forth in claim 3, wherein the desired fluid pressure is determined to cause the fuel injector (25) to produce a single injection at engine running speeds.

5. A method for controlling the pressure of a hydraulically-actuated injector (25) of an internal combustion engine (55), comprising the steps of:

sensing the temperature of the engine and producing an engine temperature signal ($T_c$) indicative of the temperature of actuating fluid used to hydraulically actuate the injector (25);

sensing the engine speed and producing an engine speed signal ($s_f$) indicative of the sensed engine speed;

receiving the engine speed and temperature signals, determining a desired actuating fluid pressure to control the rate at which injection is desired to occur, and producing a desired actuating fluid pressure signal ($P_d$) indicative of the desired actuating fluid pressure; and receiving the desired actuating fluid pressure signal ($P_d$), and producing a desired electrical current signal (I) to control fuel injection rate.

6. A method, as set forth in claim 5, including the steps of:

sensing an actual actuating fluid pressure and producing an actual actuating fluid pressure signal ($P_f$) indicative of the sensed actuating fluid pressure;

comparing the desired actuating fluid pressure signal ($P_d$) with the actual actuating fluid pressure signal ($P_f$) and producing an actuating fluid pressure error signal ($P_e$) in response to a difference between the compared actuating fluid pressure signals ($P_d$,$P_f$); and receiving the actuating fluid pressure error signal ($P_e$), determining a desired electrical current based on the actuating fluid pressure error signal ($P_e$), and producing a desired electrical current signal (I).

7. A method, as set forth in claim 6, wherein the desired fluid pressure is determined to cause the fuel injector (25) to produce a plurality of injections during a single injection period at engine cranking speeds.

8. A method, as set forth in claim 7, wherein the desired fluid pressure is determined to cause the fuel injector (25) to produce a single injection at engine running speeds.

9. A method for controlling the pressure of a hydraulically-actuated injector (25) of an internal combustion engine (55), comprising the steps of:

sensing the temperature of the engine and producing an engine temperature signal ($T_c$) indicative of the temperature of actuating fluid used to hydraulically actuate the injector (25);

sensing the engine speed and producing an engine speed signal ($s_f$) indicative of the sensed engine speed;

receiving the engine speed and temperature signals, determining a desired actuating fluid pressure to control the rate at which injection is desired to occur, and producing a desired actuating fluid pressure signal ($P_d$) indicative of the magnitude of the desired actuating fluid pressure; and receiving the desired actuating fluid pressure signal ($P_d$), and delivering a desired electrical current signal (I) to produce a plurality of injections during a single injection period.

10. A method, as set forth in claim 9, including the step of producing a desired fluid pressure signal ($P_d$) that causes the fuel injector (25) to produce a single injection at engine running speeds.

11. A method, as set forth in claim 10, including the steps of:

sensing an actual actuating fluid pressure and producing an actual actuating fluid pressure signal ($P_f$) indicative of the sensed actuating fluid pressure;

comparing the desired actuating fluid pressure signal ($P_d$) with the actual actuating fluid pressure signal ($P_f$) and producing an actuating fluid pressure error signal ($P_e$) in response to a difference between the compared actuating fluid pressure signals ($P_d$,$P_f$); and receiving the actuating fluid pressure error signal ($P_e$), determining a desired electrical current based on the actuating fluid pressure error signal ($P_e$), and producing a desired electrical current signal (I).

* * * * *